US010676234B2

(12) United States Patent
Chinni Vergottini

(10) Patent No.: US 10,676,234 B2
(45) Date of Patent: Jun. 9, 2020

(54) PLASTIC CONTAINER BELOW 450 GR FOR HORTICULTURE PRODUCTS EXPORTS

(71) Applicant: Wenco S.A., Huechuraba Santiago (CL)

(72) Inventor: Pedro Chinni Vergottini, Huechuraba Santiago (CL)

(73) Assignee: Wenco S.A., Santiago (CL)

( * ) Notice: Subject to any disclaimer, the term of this patent is extended or adjusted under 35 U.S.C. 154(b) by 71 days.

(21) Appl. No.: 15/993,948

(22) Filed: May 31, 2018

(65) Prior Publication Data

US 2018/0346184 A1 Dec. 6, 2018

Related U.S. Application Data

(60) Provisional application No. 62/514,360, filed on Jun. 2, 2017.

(51) Int. Cl.

| | |
|---|---|
| ***B65D 6/18*** | (2006.01) |
| ***B65D 6/08*** | (2006.01) |
| ***B65D 85/34*** | (2006.01) |
| ***B65D 63/16*** | (2006.01) |
| ***B65D 25/10*** | (2006.01) |
| ***B65D 21/02*** | (2006.01) |
| *B65D 6/34* | (2006.01) |
| *B65B 25/04* | (2006.01) |

(52) U.S. Cl.

CPC ..... *B65D 11/1833* (2013.01); *B65D 11/14* (2013.01); *B65D 21/0212* (2013.01); *B65D 21/0215* (2013.01); *B65D 25/101* (2013.01); *B65D 25/102* (2013.01); *B65D 63/16* (2013.01); *B65D 85/34* (2013.01); *B65B 25/046* (2013.01); *B65D 11/26* (2013.01)

(58) Field of Classification Search

CPC ..... B65D 21/0212; B65D 11/1833; B65D 2563/10; B65D 2563/00; B65D 25/102

See application file for complete search history.

(56) References Cited

U.S. PATENT DOCUMENTS

| | | | |
|---|---|---|---|
| 179,745 | A | 7/1876 | Blake |
| 2,346,887 | A | 4/1944 | Winkler |
| 3,081,506 | A | 3/1963 | Higuchi |
| 3,378,161 | A | 4/1968 | Lookabaugh |
| 3,445,901 | A | 5/1969 | Kamper |

(Continued)

FOREIGN PATENT DOCUMENTS

| | | |
|---|---|---|
| CL | 880-2014 | 3/2014 |
| CL | 879-2014 | 10/2014 |

OTHER PUBLICATIONS

Eloshway, Niki; Non-Final Office Action issued in U.S. Appl. No. 15/994,169; dated May 16, 2019; 8 pages.

(Continued)

*Primary Examiner* — Stephen J Castellano

(74) *Attorney, Agent, or Firm* — Ulmer & Berne LLP

(57) ABSTRACT

Plastic container below 450 gr for horticulture products exports formed by a bottom, two large walls facing each other, two small walls facing each other and an upper closure system, the container has an optimized structure which allows to efficiently resist the forces to which it is subjected and to control deformation for the purpose of ensuring all the time and under any conditions the integrity and quality of the products contained inside.

22 Claims, 16 Drawing Sheets

(56) References Cited

U.S. PATENT DOCUMENTS

| | | | | |
|---|---|---|---|---|
| 3,524,534 | A * | 8/1970 | Browner | B65D 25/102 206/229 |
| 4,509,645 | A | 4/1985 | Hotta | |
| 4,633,549 | A | 1/1987 | Lovato | |
| 4,995,525 | A * | 2/1991 | Kehrer | B65D 25/102 206/805 |
| 5,161,710 | A | 11/1992 | Chumley | |
| 5,193,304 | A | 3/1993 | Krueger | |
| 5,440,792 | A | 8/1995 | Ida | |
| 6,142,329 | A | 11/2000 | Dotan | |
| 7,017,765 | B2 * | 3/2006 | Overholt | B65D 11/1833 220/6 |
| D688,869 | S | 9/2013 | Lindstrom | |
| 10,029,184 | B2 | 7/2018 | Lam et al. | |
| 2003/0136781 | A1 | 7/2003 | Rumpel | |
| 2006/0059776 | A1 | 3/2006 | Luken et al. | |
| 2007/0017916 | A1 | 1/2007 | Sabanci | |
| 2009/0007395 | A1 | 1/2009 | Ida | |
| 2011/0108558 | A1 * | 5/2011 | Magni | B65D 11/1833 220/592.01 |
| 2011/0315689 | A1 | 12/2011 | Meints et al. | |
| 2012/0103851 | A1 * | 5/2012 | Ruiz Carmona | B65D 1/38 206/459.5 |
| 2012/0211390 | A1 * | 8/2012 | Hassell | B65D 1/34 206/510 |
| 2014/0209499 | A1 | 7/2014 | Hobson | |
| 2014/0263885 | A1 | 9/2014 | Oltman | |
| 2014/0291193 | A1 | 10/2014 | Heyman | |
| 2015/0283745 | A1 | 10/2015 | Chinni Vergottini et al. | |
| 2015/0284135 | A1 * | 10/2015 | Chinni Vergottini | B29C 45/0017 206/503 |
| 2016/0324079 | A1 | 11/2016 | Belschner | |
| 2017/0073107 | A1 | 3/2017 | Nakai | |
| 2018/0072455 | A1 | 3/2018 | Wilcox | |
| 2018/0346185 | A1 | 12/2018 | Chinni Vergottini | |
| 2018/0346186 | A1 | 12/2018 | Chinni Vergottini | |
| 2018/0346187 | A1 | 12/2018 | Chinni Vergottini | |
| 2018/0346188 | A1 | 12/2018 | Chinni Vergottini | |
| 2018/0346189 | A1 | 12/2018 | Chinni Vergottini | |
| 2018/0346190 | A1 | 12/2018 | Chinni Vergottini | |
| 2018/0346191 | A1 | 12/2018 | Chinni Vergottini | |

OTHER PUBLICATIONS

Castellano, Stephen; Non-Final Office Action issued in U.S. Appl. No. 15/994,251; dated Oct. 11, 2019; 7 pages.

Castriotta, Jennifer; Non-Final Office Action issued in U.S. Appl. No. 15/994,211; dated Sep. 27, 2019; 14 pages.

Castriotta, Jennifer; Non-Final Office Action issued in U.S. Appl. No. 15/994,082; dated Oct. 28, 2019; 9 pages.

Castellano, Stephen; Non-Final Office Action issued in U.S. Appl. No. 15/993,982; dated Oct. 30, 2019; 7 pages.

* cited by examiner

PLASTIC CONTAINER BELOW 450 GR FOR HORTICULTURE PRODUCTS EXPORTS

This application claims domestic priority to provisional application Ser. No. 62/514,360 filed Jun. 2, 2017.

FIELD OF THE INVENTION

The present invention is related to the field of the plastic containers used for horticultural products exports, also denominated as "One Way" containers, specially those containers weighing below 450 gr.

BACKGROUND OF THE INVENTION

At present, there is an unlimited number of containers designs used for storage and transportation of fruits and vegetables throughout the production chain, that is to say, from harvesting until the sale to the final consumer. Said diversity is associated to the active development that the packaging industry currently has, whose main target has been always the same, to search an optimal product having a cost and a weight as low as possible while it is robust and provides the necessary features for the intended use.

Thus, the existing relationship between the weight and the container structural strength has become a key factor, since reducing significantly the container weight many times may produce a loss of structural strength of the same which affects to a substantial extent the packaging conditions and the integrity of the products themselves. On the other hand, said loss of weight is associated to a reduced use of material, which leads to an important cost reduction, crucial issue in a competitive industry like the packaging industry where the use of plastic has been gradually taking away market share to the cardboard industry specially for its good resistive properties.

Therefore, the strength and weight parameters are critical in particular at the exports stage, where it is necessary that the container with products withstands the transport and storage conditions during extended periods of time and distances, also being relevant that it allows to maintain the products inside in excellent conditions protecting them from bumps and crushings often produced even because of poor conditions of the containers stacking which does not maintain their integrity when arranged in the pallet and also when the latter is subsequently fastened with moorings or "strapping", as this operation is frequently called.

In this context, for the export of products in the fruits and vegetables industry, mainly when the transport distances are significantly, often it is preferred the use of plastic containers because they have a better structural strength and a better resistance to environmental conditions such as moisture, than the cardboard containers do. Said containers are organized in pallets and usually they are covered with a bag to preserve the products conditions for long periods of time when they are transported inside containers and refrigerated lorries.

Said containers are often called "One Way", as the name implies, they have one way or direction, that is to say, they are sent from the place of origin to the place of destination without being used again for the same purpose, where they are regularly destroyed and subsequently recycled.

The state of the art describes some examples of One Way plastic containers, for example those disclosed by the Applicant in the Applications CL 879-2014 and CL 880-2014. Said Applications suggest a plastic container with collapsible walls whose objective is to significantly reduce weight but without sacrificing the structural strength.

In order to achieve this objective, the Application CL 879-2014 suggests a novel light connection system between the containers walls, consisting of a clip type closure device incorporating a hollow tubular column fixed to the faces. By means of this connection system it is possible to significantly reduce the amount of material in the containers corners without lowering the structural strength even increasing it, since it takes advantage of the firm structure of the hollow column incorporated to the closure system which provides a firm and easy connection between the container walls.

In turn, the Application CL 880-2014 suggests a bottom for a collapsible plastic container which is able to reduce the container weight by means of the T shaped ribs of variable height strategically distributed in the bottom. Said ribs allow to efficiently distribute forces towards the container frame and therefore to avoid material in zones which do not require great forces.

With the systems suggested by the above mentioned references, the Applicant could reduce the weight of the plastic containers known at that time in approximately 11%, obtaining a container of just 310 grs. Nevertheless, currently the technology advances, the increasing demand of goods in the food industry and the commitment to reduce the carbon footprint, force manufacturing industries to continue improving their products.

Thus, although the containers suggested by documents CL 879-2014 and CL 880-2014 show a significant improvement in the strength to weight ratio, in order to satisfy the above mentioned issues, progressing to a second level is critical where the progress not only means to reduce production costs but also to provide improvements to ensure a better quality of the products transported in One Way containers minimizing the losses associated to damages done during the transport and storage processes and thus complying with the quality standards required by the horticulture industry for the export products.

Therefore, the objective of the present invention is to improve the above mentioned plastic containers of the state of the art furnishing a One Way container which provides a better strength to weight ratio. In particular, the aim is to produce a container weighing below 300 grs with sufficient stiffness so as to ensure the integrity of the products inside it and a controlled deformation on forces originated during palletizing maintaining its structure all the time.

DESCRIPTION OF THE INVENTION

The present invention consists of a plastic container below 450 gr for exports of horticulture products, which preferably has a rectangular shape and it is formed by a bottom, two large walls facing each other, two small walls facing each other and an upper closure system. According to a preferred embodiment of the invention, the walls of the container are collapsible being these attached to the bottom and interconnectable. Nevertheless, the present invention is not limited only to this type of containers also said walls can be fixed.

The containers walls are formed by a rectangular shaped frame which comprises a wall framework divided by pillars inside it. According to a first embodiment, all the walls have a framework except one of the small walls which may comprise continued surfaces between pillars, which are usually used in the technique for illustrating logos, advertisement or any type of related information.

According to a second embodiment the container large walls are closed being formed by full and flat sections positioned between the pillars.

Both, in the embodiment of closed large walls and in the embodiment of ventilated large walls, the sections positioned between the pillars are slightly curved outwards for compensating the contraction produced during the manufacturing process as a result of the cooling rate with the walls frame, in this way allowing to maintain a controlled deformation. As a result, in the embodiment of closed large walls, said curvature allows to reduce the walls thickness so that the final weight of the container is not increased in relation to the embodiment of the large walls with framework (ventilated).

In the second embodiment, having full large walls provides a better visual aesthetic of the containers positioned in the pallet and the possibility to include logos, advertisement or any type of related information.

Another important feature of the container walls is related with the ventilation conditions that these provide to the content stored inside it. In this regard, the design of the small wall or head arranged outwards in the pallet enables the air inlet along the entire contour of the continued zones. Thus, the ventilation is evenly distributed inside the container.

Advantageously, in the embodiment where the container large walls are closed, the air entering the container head is prevented from escaping through the separation between adjacent containers arranged in the pallet, therefore increasing the residence of cooling air inside the container and better preserving the products inside it.

Also, the number of secondary or central pillars forming the container walls has been reduced, so in the small walls the number of secondary pillars is only two but they are arranged together in the center while in the large walls the number of pillars is only three.

Advantageously, a few secondary pillars enable a significant reduction in the container total weight, but without losses in the structure final strength. On one side, this is due to the fact that in the small walls a higher strength is requested in the center, since it is the zone from which the workers usually grab the container. Therefore, having a configuration of two secondary pillars together allows to ensure the strength in said critical point. On the other hand, the reduction of pillars in the container large walls is possible because these are not requested to control deformation in the walls since now the straps carry out this operation together with the wall pre-bent condition.

According to another aspect of the invention, the large walls and one of the small walls have a curved upper profile outwards the container. Advantageously, this pre-bent condition enables the walls to curve outwards when the container is subjected to higher loads, for example when they are stacked in a pallet. By doing so, the walls are prevented to curve inwards due to the force exerted by the clamps, crushing the products causing deformation or damage.

A similar effect is obtained by means of the closure system of the present invention consisting of three straps equidistantly distributed in the upper face of each large wall of the container, which converge in their ends in the respective hook means being connected in the container center. The wall three straps assembly has an additional strap connecting with a projection positioned in the upper face of the pre-bent small wall (the one looking outwards the pallet). Said additional strap acts as support so as when the pallet is strapped, the large walls and the pre-bent small wall are not excessively curved outwards because of the compression force that the clamp exerts on them, therefore maintaining a controlled deformation range ensuring the container integrity.

Advantageously, the straps terminals positioned at the end of each large wall have been placed very close to the columns of the container corners. This position reduces the large walls bending inwards allowing to maintain the integrity of the products within the container, since when there is a short distance between the straps terminal and the column, the torque exerted by the stretched straps on the walls when the closure system is activated, is low.

Another advantage associated to this configuration is related to the fact that the cross formed between the straps of the opposite ends of each side of the walls is more aligned with the container diagonals, causing that the tension forces produced by the straps are distributed to the columns and not to the container middle zone, decreasing the deformation thereof.

In turn, the connection media between the straps forming the closure system consist of a snaps system formed, according to a first embodiment, by a female end and a male end tip top buckle type. Said system allows for a quick, easy and user-friendly connection between the straps.

According to a second embodiment, the female end is square shaped with a central opening with guide and retention elements. In turn, the male end has a head configured to be introduced in the female end opening being trapped with the retention elements allowing for an easy connection and disconnection.

On the other hand, guides connecting the container walls have been provided in the system. Said guides are shaped like triangular ribs arranged in the female connector inlet and they help to introduce quickly and clearly the male connector in the female connector.

Another relevant aspect of the container is related with the bottom features, wherein the bottom framework is displaced in relation to the frame into the container. Such displacement being lower and continued in the center zone of the frame and being higher towards the container corners, therefore forming a parabolic profile of the framework of which highest point is positioned in the corners and the lowest point is positioned in the frame center.

Advantageously, this configuration enables to reduce the bottom framework, on one side providing a relevant weight reduction but on the other hand, a greater bottom deformation as a result of the content weight within the container above a thinner bottom. However, the bottom maximum deformation is not increased, since the bottom displacement allows the beginning and ending of the deformed distance to begin at a higher height in relation to the bottom frame, so that said deformation does not affect the container products when positioned underneath in the pallet. This configuration also does not reduce the container usable volume since the bottom areas laying over the products support surface are positioned in the walls contour and specially in the corners, these spaces are usually not filled with horticulture products or others not having right-angled corners.

In order to improve the container structure, the bottom comprises rectangular beams in the diagonals joining the bottom outer frame profiles. According to embodiments of the invention, the beams may be straight or half straight, curved towards the corners, upwards or both. This configuration allows the beams to adopt a pre-tensioned position compensating the deformation produced by the forces to which the container is subjected when loaded and arranged in the pallet, enabling to ensure its structural stiffness and the integrity of the products.

Advantageously, the use of these diagonal beams in the container bottom reduces the frame profiles tendency to be "closed" when the bottom is loaded, that is to say, it prevents the initial 90° to be significantly reduced causing bottom deformations and damaging the products. Another advantage is related to the reduction of the bottom deformation surface, since due to the diagonal beams the bottom does not deform from the pillar towards the center, but mainly from the beams obtaining a more controlled deformation and transmitting forces to the frame itself through the beams, which is the most resistant element of the bottom.

An additional advantage associated to the bottom diagonal beams is that they support the container corners zone which is the most tensioned when it is subjected to loads. In order to assist, the bottom framework positioned between each pillar and each beam also comprise T shaped ribs which help to reinforce said most tensioned zone and to compensate the bottom height difference between the corners and the frame center, facilitating less deformation.

Another feature of the T shaped ribs is that the height is aligned with the lower face of the diagonal beams. This one expedites the containers transport operations in automatized systems using automatic transport lines, since it prevents the wheels of said systems to be introduced in the space formed between the corner and the beam.

In addition, the bottom frame has a reinforced structure which allows to add higher load reducing the bottom deformation and better supporting the strapping forces. On the other hand, the thickness and/or width of the framework has been reduced within the triangular zones placed in each bottom face center. Because the bottom framework zones are less subjected to forces it is possible to reduce the thickness and/or width without significantly reducing the bottom maximum deformation but significantly reducing the container final weight.

The container of the present invention has hollow tubular columns, this structure resists a great vertical load and the forces transmitted from the bottom and walls. The container columns have a cross section formed by straight portions at the sidelines and a curved portion at the inner side. Unlike the state of the art containers wherein the portion of the column outer side is straight, in the present invention said outer portion comprises a curved ratio allowing to improve the column sag resistance making it more similar to a cylinder. Accordingly, it is known that a cylinder shape is more resistant but at the same time provides less contact surface in its mantle, which may affect the attachment of the walls to the container with the cylindric column and fitting with adjacent containers.

In order to compensate this contact surface reduction in the column outer face, vertical bits protruding from the surface and which allow to fit with the ones of a continued container reducing displacement among them, have been included thereof.

According to the present invention, a separation or space is provided between pillars and small faces of the container walls, preferably that arranged outwards a pallet. Said separation is deeper in the container upper portion gradually decreasing towards the lower portion and it advantageously allows a slight movement between the pillar and the wall, so that when the first deflects inwards as a result of the pressure exerted by the straps during palletizing, it has a wider range of motion before compressing the wall preventing or reducing deformation thereof.

Another significant feature of the present invention is related to the means facilitating the containers palletizing. First of all, the column in each corner finishes in the container bottom in a projection in the form of half ellipse, which has a slight conicity in the lateral faces and in the face aiming outwards the pallet. On one side, said projection improves the stacking between containers, since its shape allows it to penetrate in the column upper opening of the lower container and on the other hand, facilitates the removal because due to the conicity it is easier to displace the projection from the column upper opening in only one direction while in the opposite direction the projection is locked in order to ensure the coupling between containers. To that end, the ribs surrounding the projection also have been reduced.

Secondly, the container of the present invention comprises trapezoidal centering devices in the upper face of the large walls and in the bottom it comprises several channels arranged one after another fitting with the centering devices. Thus, when the containers are arranged in the pallet, de lower container centering devices are trapped in the channels of the upper container to avoid displacement between containers. Also, the arrangement of multiple channels allows that the centering devices adopt several contact positions with the upper container frame to anticipate deformation and to control it on the basis of the conditions and forces to which the container is subjected at the different stages of the stacking and transport process.

On the other hand, the trapezoidal shape of the centering devices allows that the stacked upper container may be displaced and removed from the pallet, acting jointly with the lower conic projections of the columns.

The above mentioned characteristics and advantages correspond to a combination of improvements in different aspects or elements of the container. The result is the obtention of a One Way plastic container with a weight below 300 gr, in other words, significantly lighter than the containers known in the state of the art, but at the same time with an optimal structure allowing to efficiently resist the forces to which the container is subjected and to control deformation for the purpose of ensuring all the time and in any conditions the integrity and quality of the products contained inside.

DETAILED DESCRIPTION OF THE INVENTION

Figure 1:
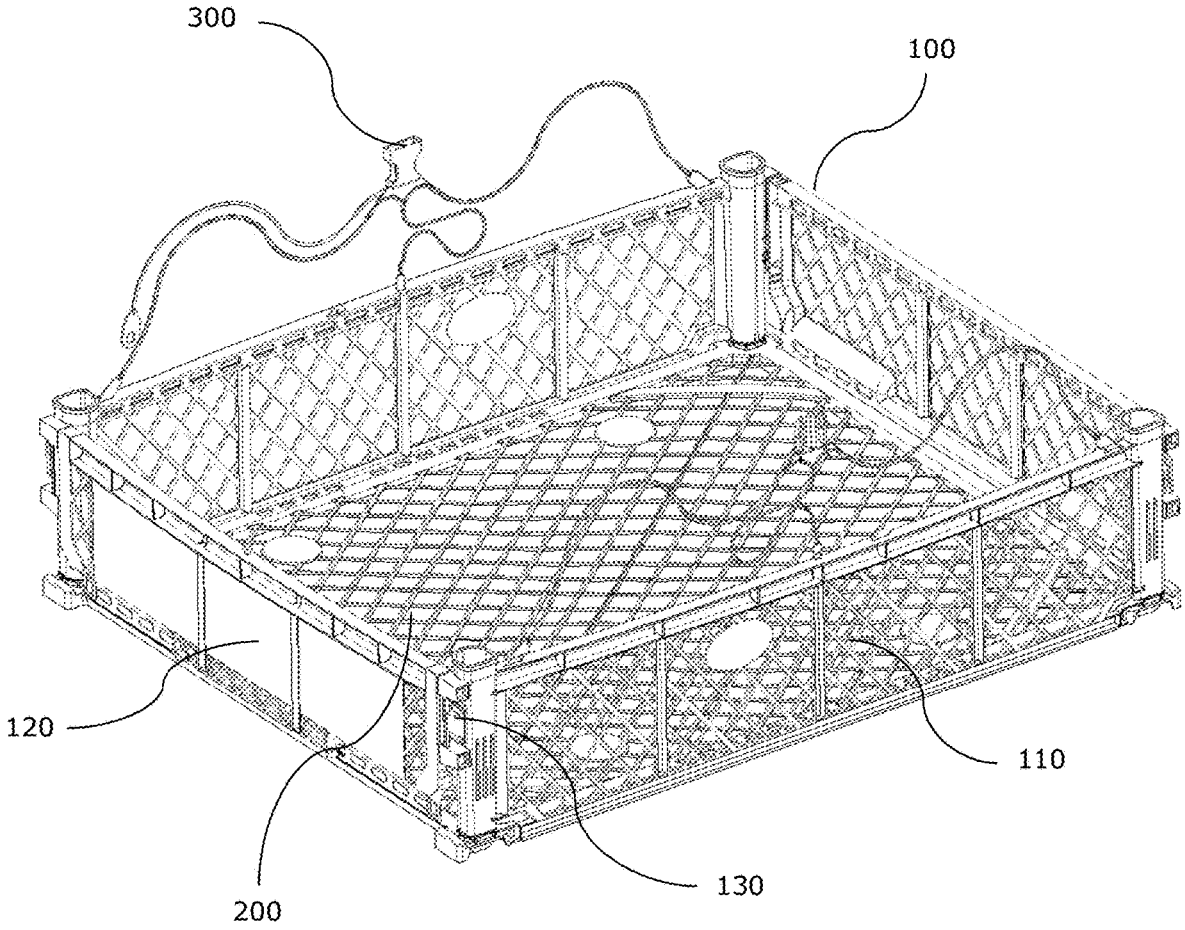
FIG. 1 illustrates an isometric view of the container of the present invention.

According to FIGS. 1 to 4 the present invention consists of a plastic container 100 preferably rectangular being formed by a bottom 200, large walls 110, small walls 120 and an upper closure system 300. According to the illustrated embodiment, the container walls 110, 120 are collapsible being attached in a fixed manner to the bottom 200 and being connectable each other by wall connection media 130.

Figure 2:
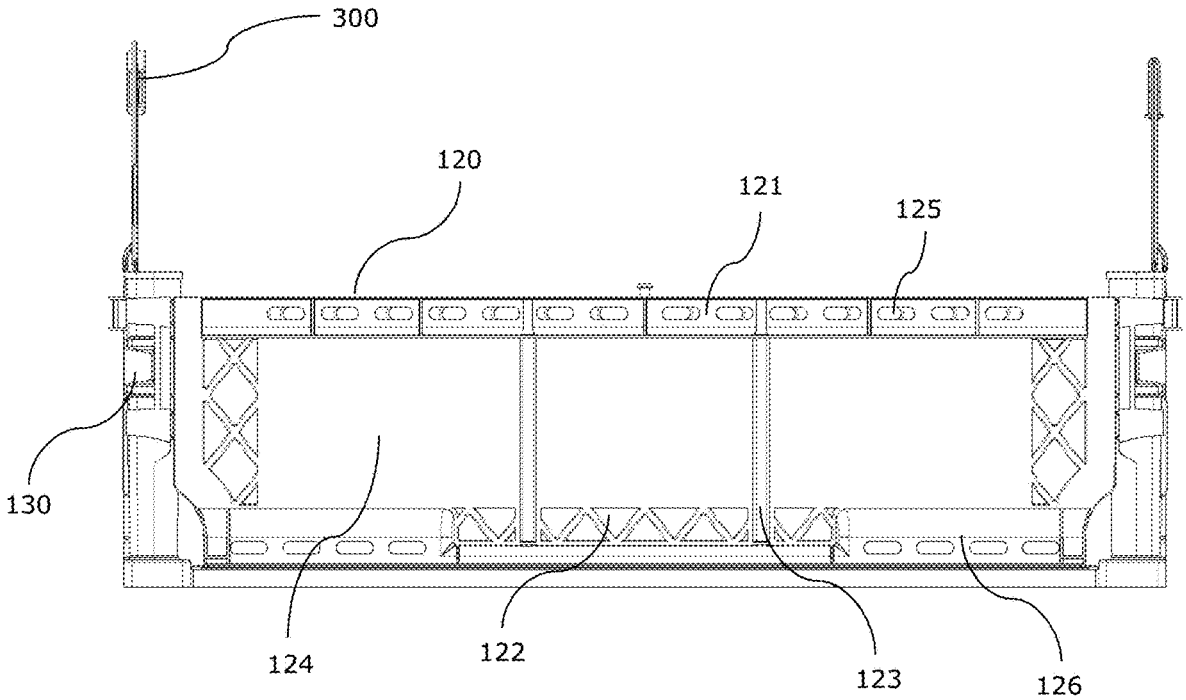
FIG. 2 illustrates an anterior elevation view of the container of the present invention.
Figure 3:
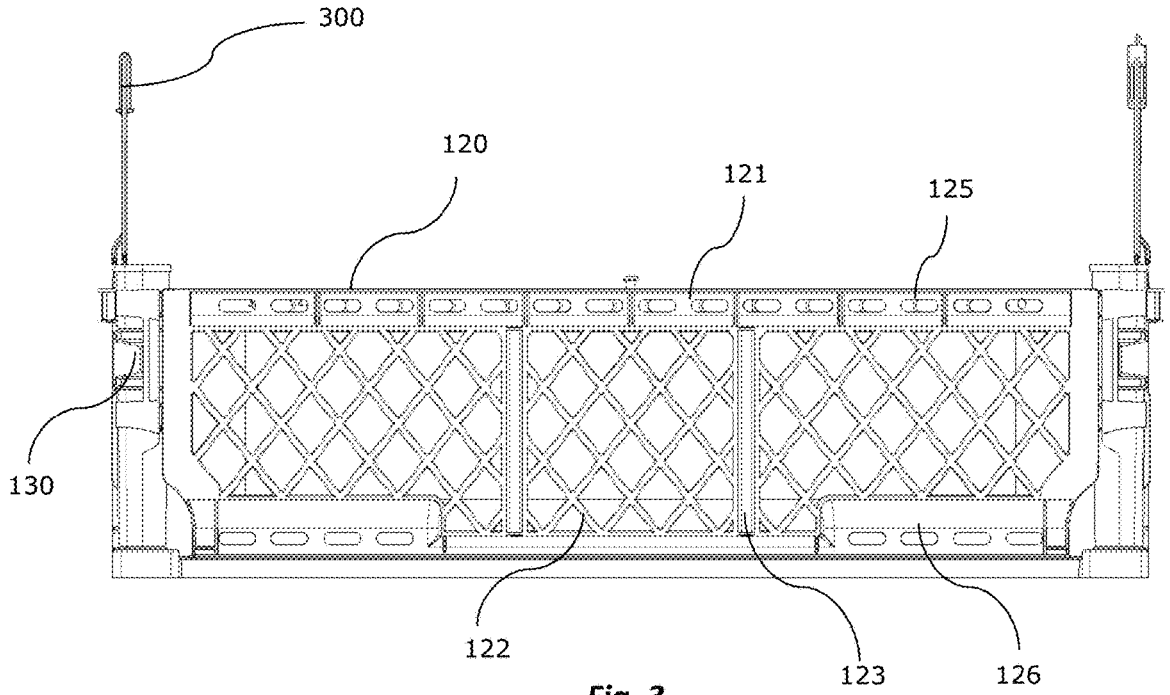
FIG. 3 illustrates a posterior elevation view of the container of the present invention.

According to FIGS. 2 and 3, the small container walls 120 are formed by a small wall frame 121 rectangular in shape which comprises inside a small wall framework 122 divided by two small wall secondary posts 123 placed in the wall center. As it can be seen in FIG. 2, one of the small walls may comprise closed surfaces 124 between the small wall secondary posts 123.

The small wall frame 121 may comprise in its upper portion a series of holes 125 in order to lighten the structure, in the lower portion two recesses 126 which houses the upper container columns when they are in folded state to reduce the stacking volume, are configured. Preferably, said recesses comprise holes in order to facilitate the air passage inside the container.

Figure 4:
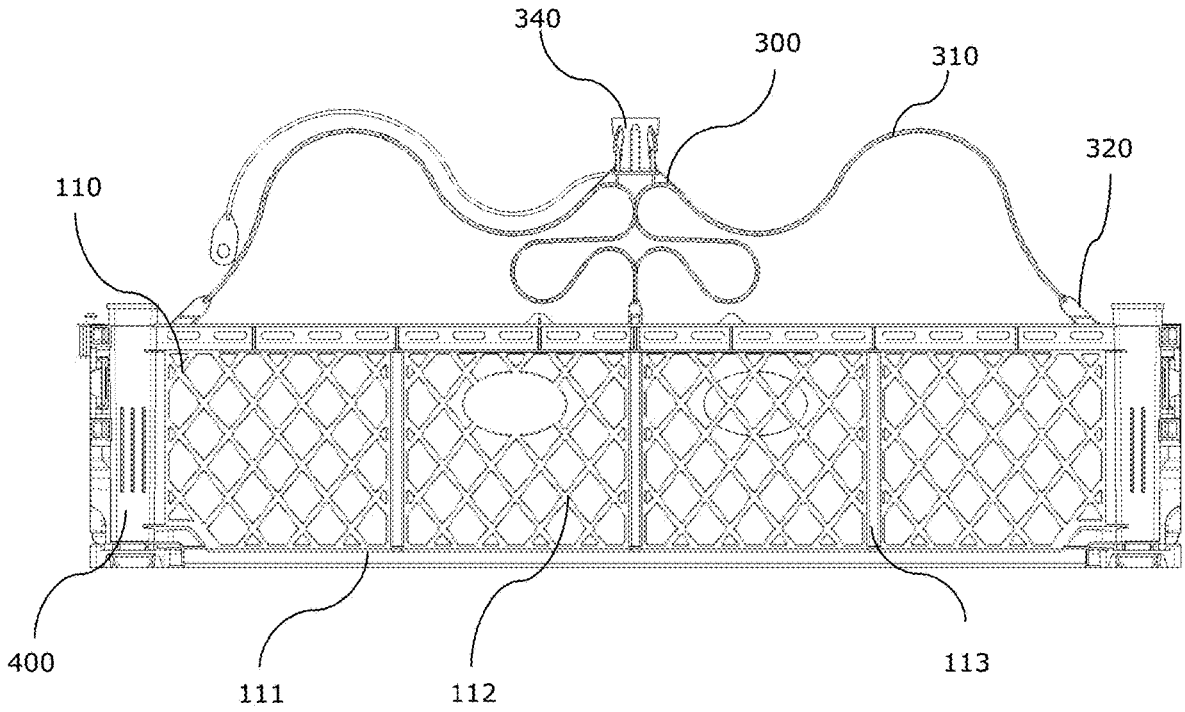
FIG. 4 illustrates a profile view of the container of the present invention.

According to FIG. 4, the container large walls 110 are formed by a large wall frame 111 rectangular in shape which comprises inside a large wall framework 112 divided by three large wall secondary posts 113 equidistantly positioned. Preferably, the portions of the large wall 112 framework placed between the posts are slightly curved outwards. In the lateral ends of the large walls 100, there are vertical columns 400 which are part of the frame. Also, in the upper portion of the frame a series of holes to lighten the structure may be configured while in the frame upper face the container upper closure system media 300 is arranged.

Figure 5:
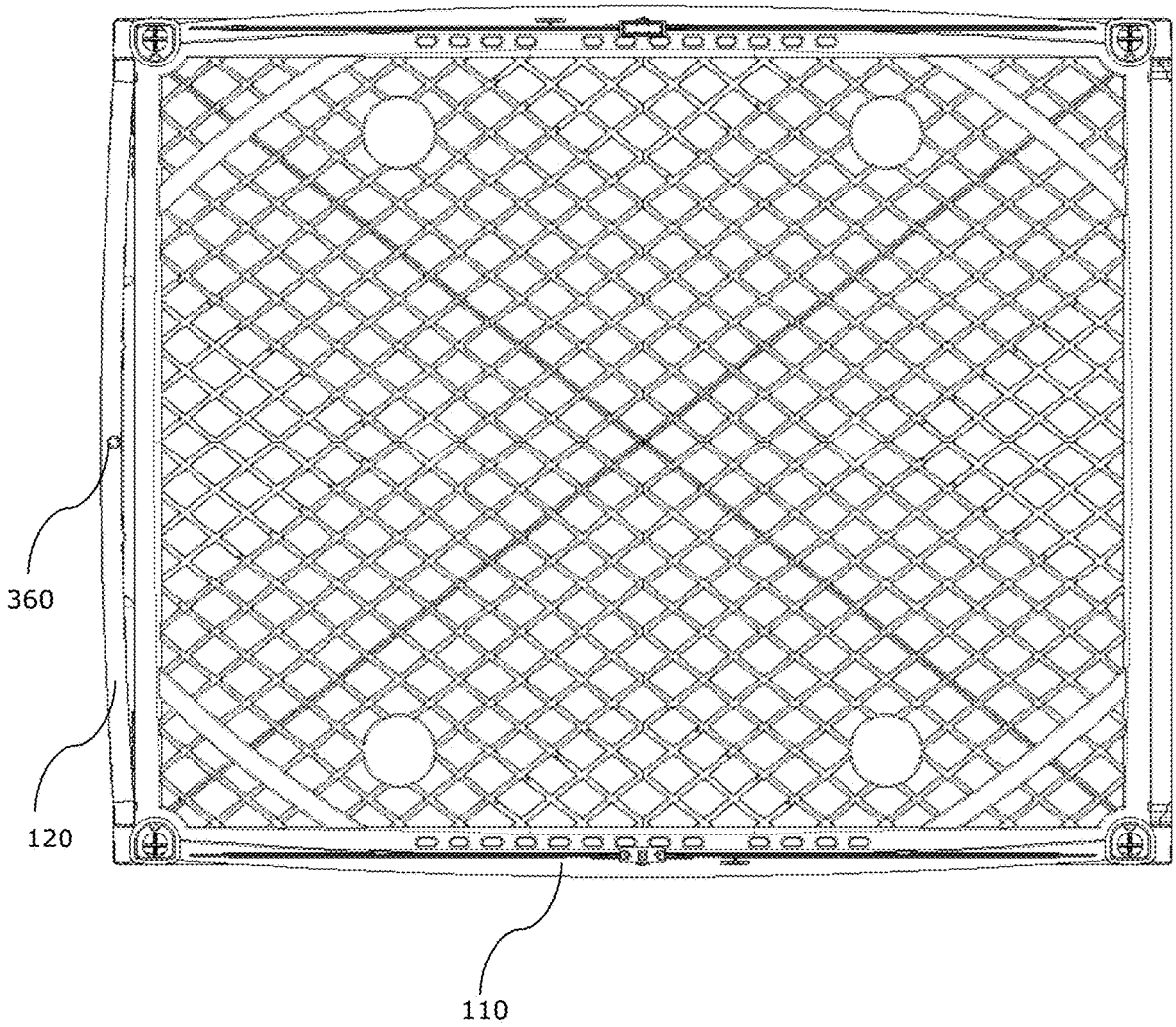
FIG. 5 illustrates a top view of the container of the present invention.
Figure 6:
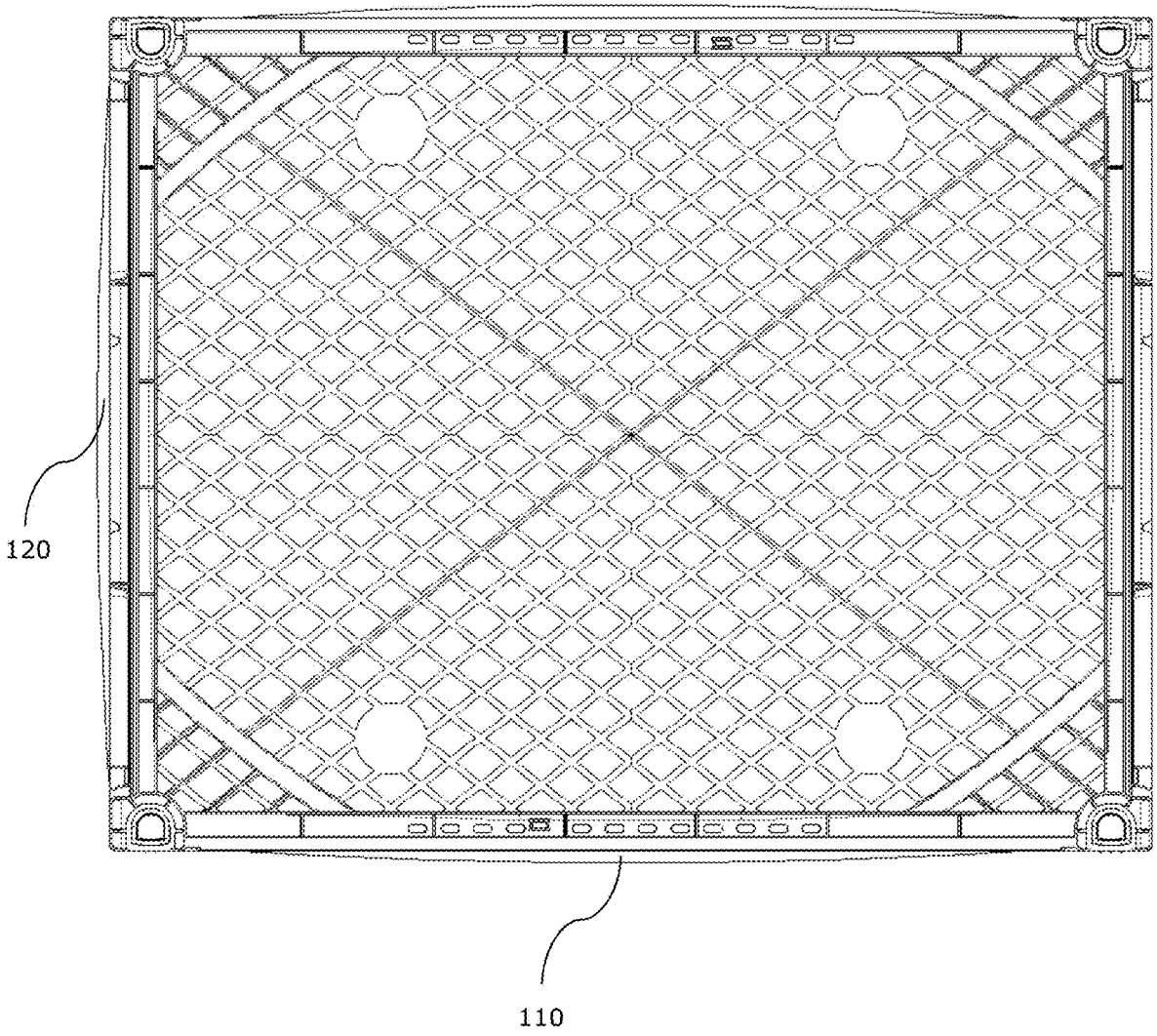
FIG. 6 illustrates a lower view of the container of the present invention.

According to FIGS. 5 and 6, the container large walls 110 and one of the small walls 120 have the upper profiled curved outwards. In the illustrated embodiments, it can be seen that the container walls are pre-bent outwards except the right small wall, because when placing the container in a pallet said wall is inside it contacting the wall of an adjacent container, therefore it does not bend inwards as a result of the force produced by the clamps.

Figure 7A:
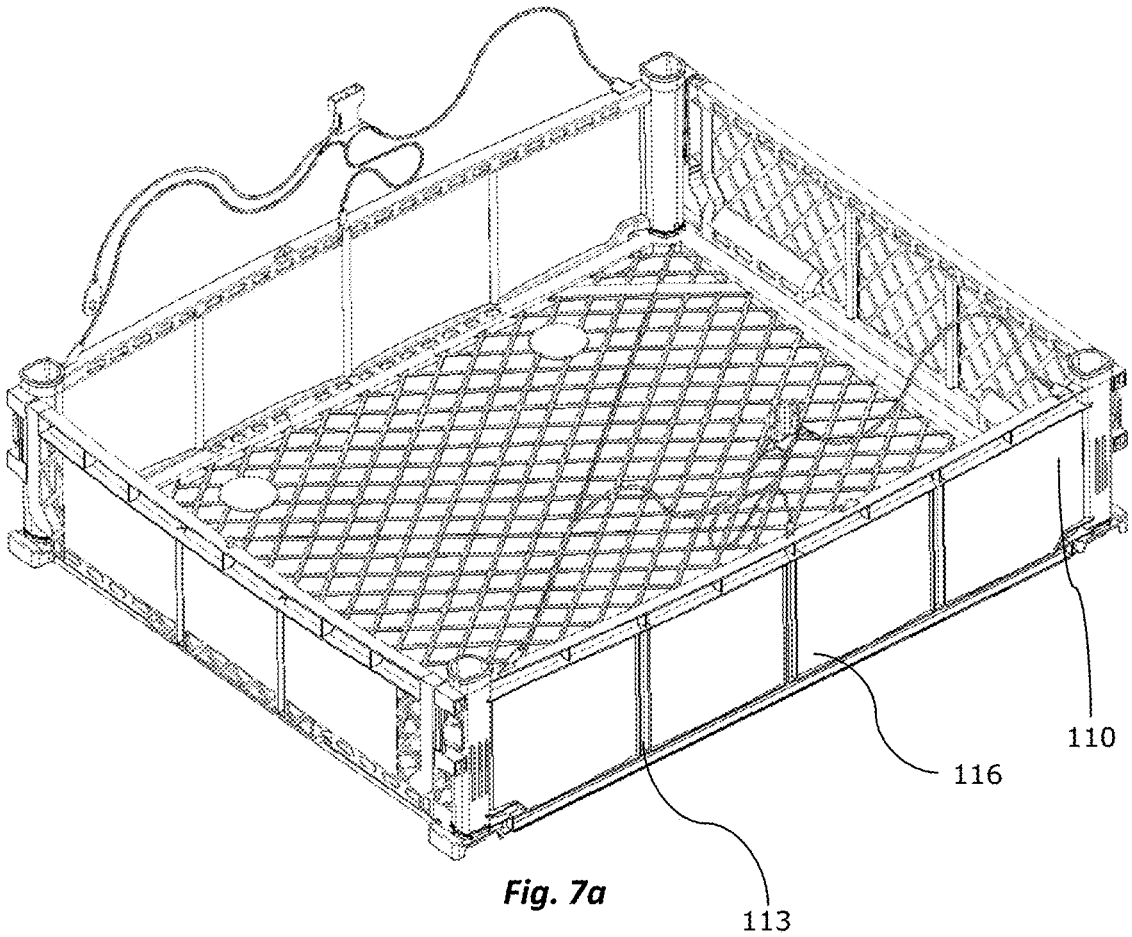
FIG. 7*a* illustrates a second embodiment of the walls of the container of the present invention.

FIG. 7*a* illustrates an alternative embodiment of the present invention wherein the container large walls 110 are closed being formed by quadrangular sections 116 placed between the large wall secondary posts 113 which have a low thickness, they are preferably flat and are slightly curved outwards.

Figure 7B:
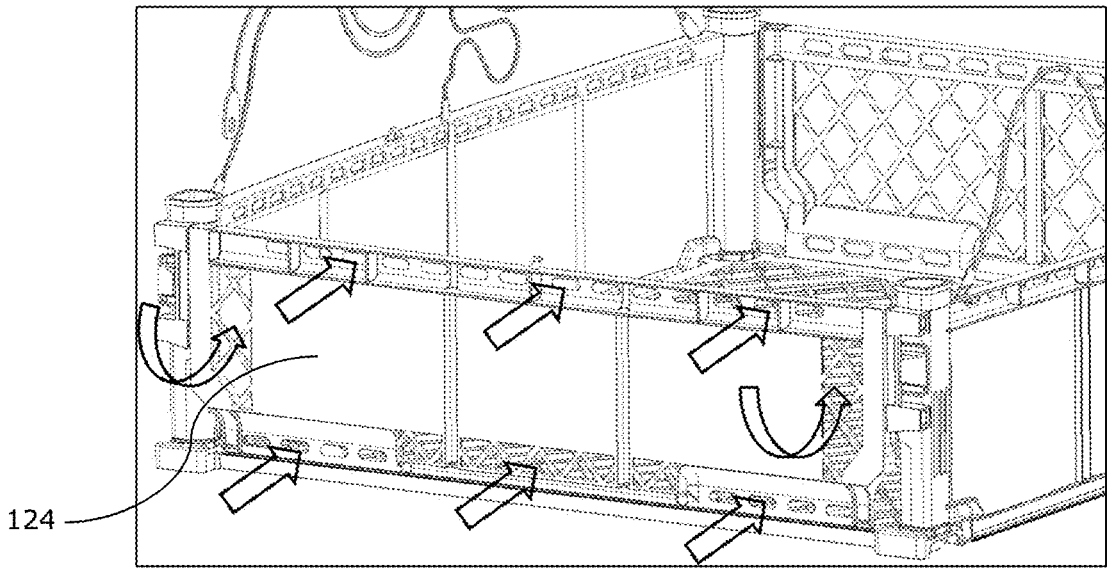
FIG. 7*b* illustrates a representation of the air flow entering inside the container of the present invention.

As it can be seen in FIG. 7*b*, the small wall configuration 120 comprising closed surfaces 124 between pillars allow the air inlet through the frame holes and the open framework zone in the lateral and lower ends of the frame as represented by arrows in said FIG. 7*b*.

Figure 8:
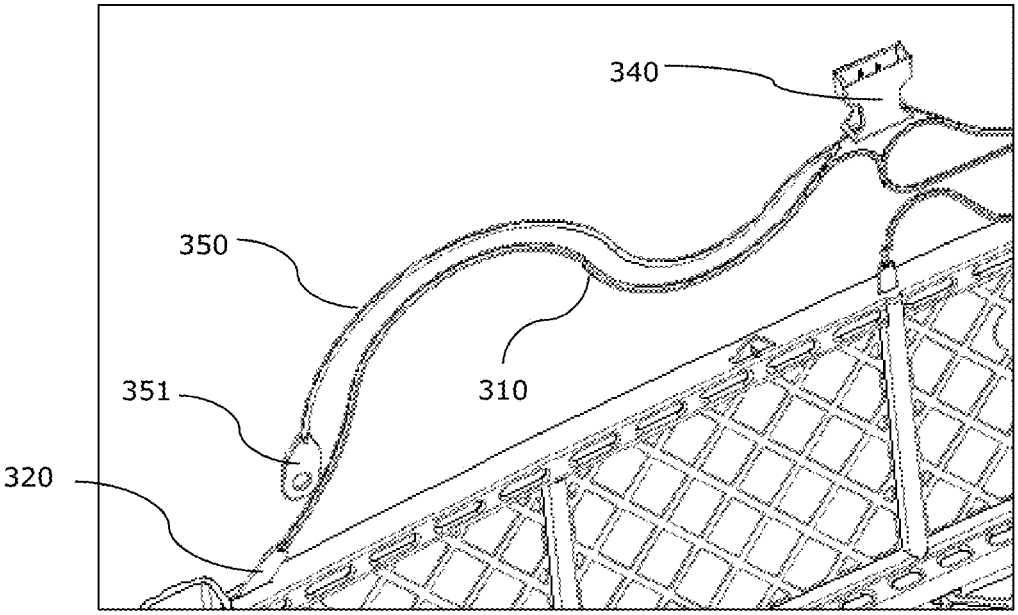
FIG. 8 illustrates a detail of the closure system of the container of the present invention.

As illustrated in FIGS. 4 and 8 the container upper closure system 300 consists of three flexible straps 310 equidistantly distributed in the upper face of each container large wall 110 thus attached fixedly by means of terminals 320. The three straps 310 of each large wall 110 converge in their ends in a hook means 340 and as it can be seen in FIG. 8 the three straps assembly of one of the large walls has an additional strap 350 which consists of an elongated element attached to the zone in which the three straps converge at and which comprises in its free end, a hole shaped connector 351 connected to a projection 360 (see FIG. 5) positioned in the upper face of the pre-bent small wall 120.

Figure 9:
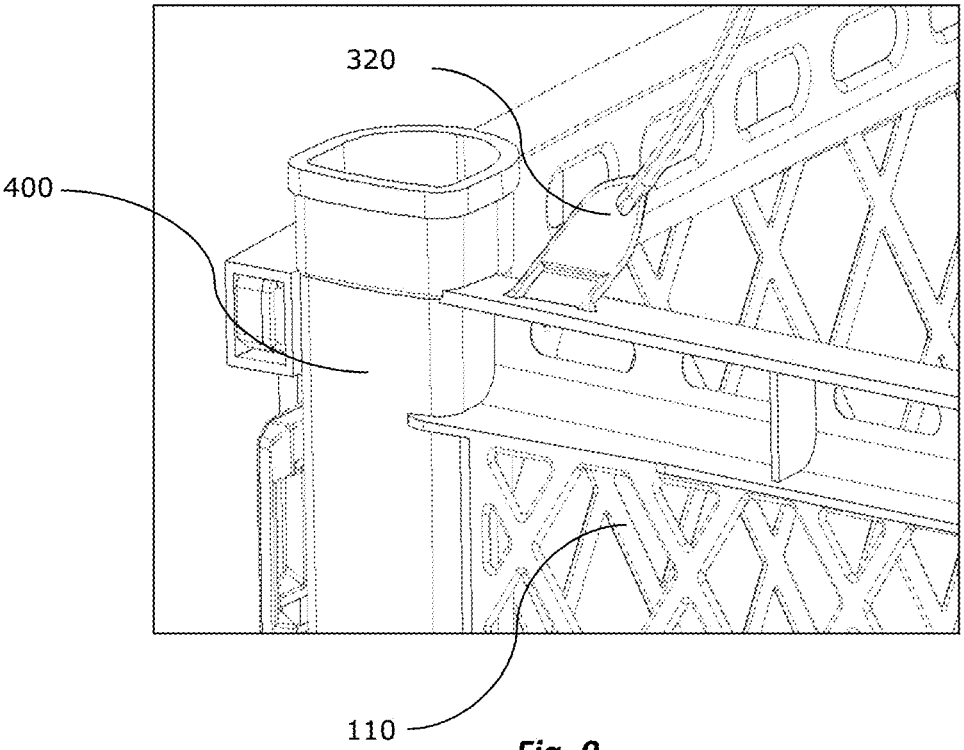
FIG. 9 illustrates a detail of the connection between the large walls and the closure system terminals of the container of the present invention.

As illustrated in FIG. 9, the straps terminals 320 placed in each large wall 110 ends are positioned very close to the columns 400 placed at the container corners, so that when the upper closure system 300 is activated the straps 310 of the opposite ends of each wall approximately match the container diagonals.

Figure 10A:
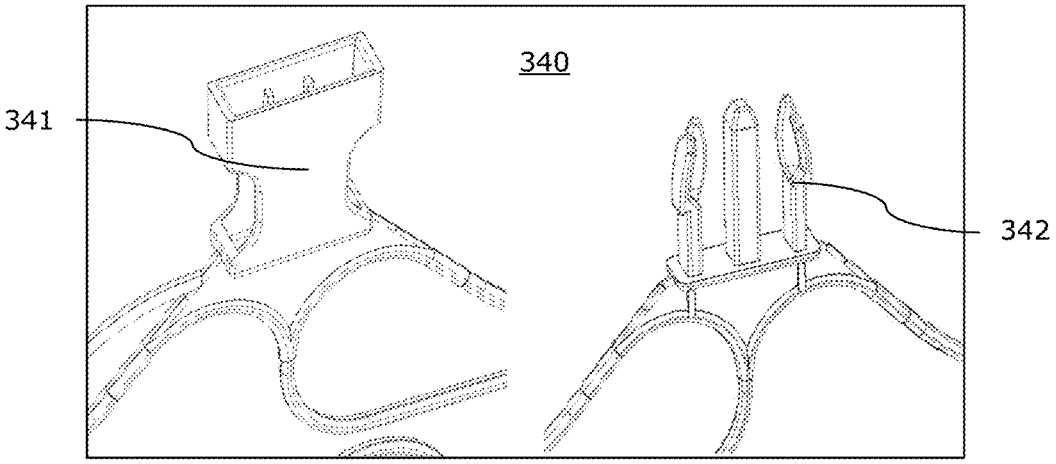
FIG. 10*a* illustrates a first embodiment of the closure system connection media of the present invention.

As it can be seen in the embodiment of FIG. 10*a*, the hook means 340 of the straps system consists of a tip top buckle type snaps system, that is to say, formed by a hollow female end 341 and a trident shaped male end 342, so that for the closing operation the male end is inserted in the female end being the trident retained in the inner space of the female end. Therefore, and for the removal of the male end 342 from the female end 341, it is enough to press the trident edges and to slide it through the female end 341.

Figure 10B:
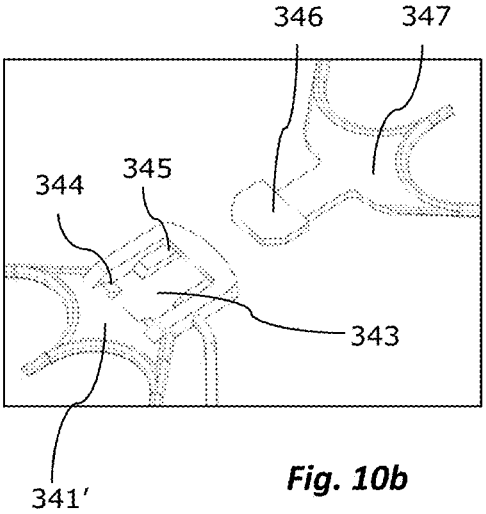
FIGS. 10*b* to 10*d* illustrate a second embodiment of the closure system connection media of the present invention.
Figure 10C:
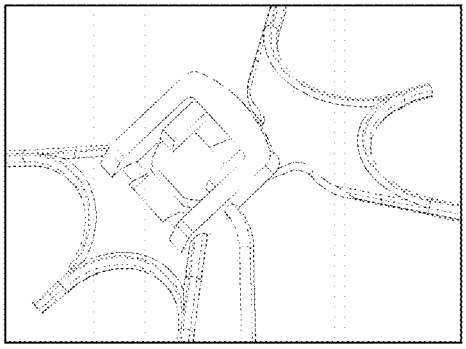
Figure 10D:
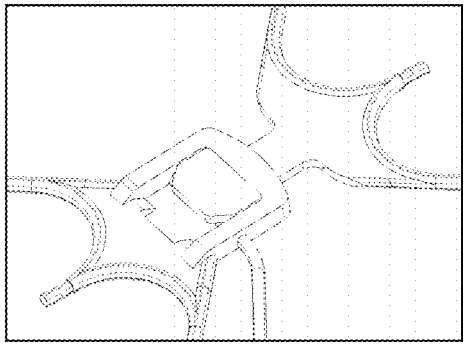

According to a second illustrated embodiment of FIGS. 10*b* to 10*d*, a square shaped female end 341' is provided with a central opening 343 with guide 344 and retention 345 elements which consist of projections placed in the opening vertexes 343, the guide elements 344 having pyramid shape and the retaining elements having parallelepiped shape with beveled end and being longer than the first ones.

In turn, the male end 347 has an hexagonal shaped head which is configured to be introduced in the female end opening sliding over the guide elements 344 and being retained by the retention elements 345 between the opening walls 343, as it can be seen in the sequence illustrated by FIGS. 10*c* and 10*d*.

Figure 11:
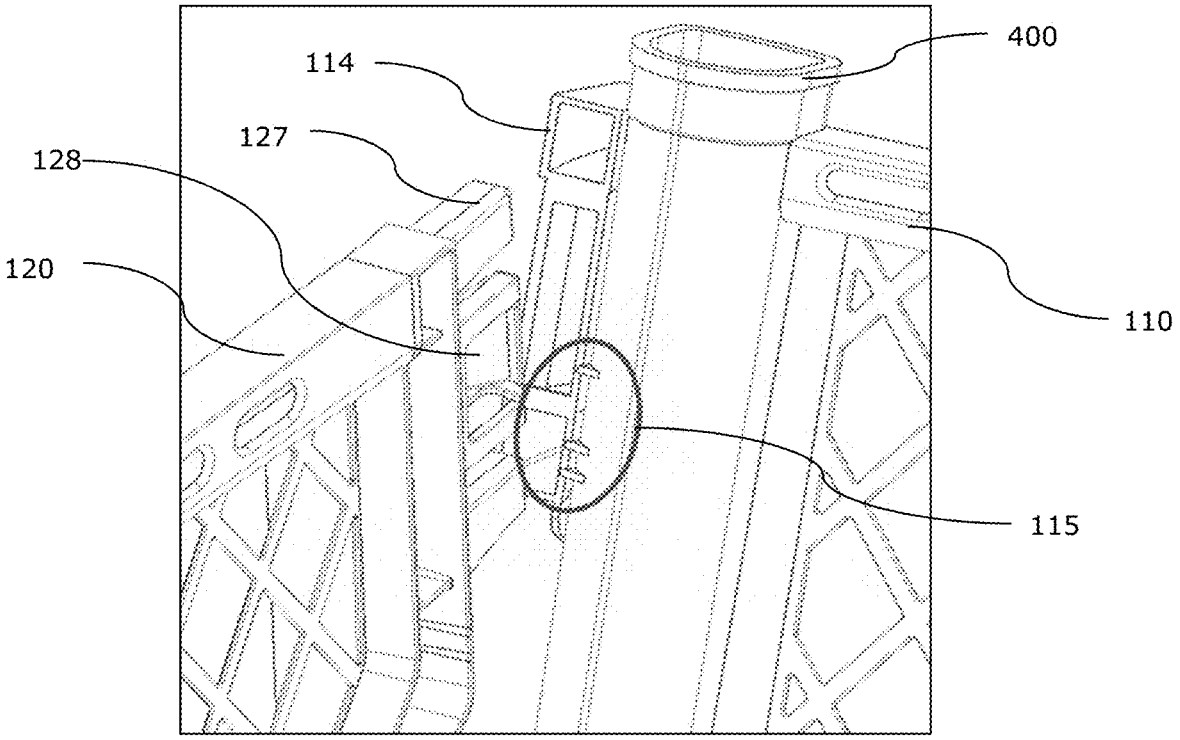
FIG. 11 illustrates a detail of the container walls connection elements.

FIG. 11 shows the connection elements connecting the container walls ends in their collapsible embodiment. According to the illustration, the small walls 120 ends comprise a male connector 127 protruding from the outer edge of the small wall frame. The large walls ends 110 comprise a female connector 114 attached to the column lateral face 400 and configured to receive the male connector 127 of the adjacent small wall.

Figure 17:
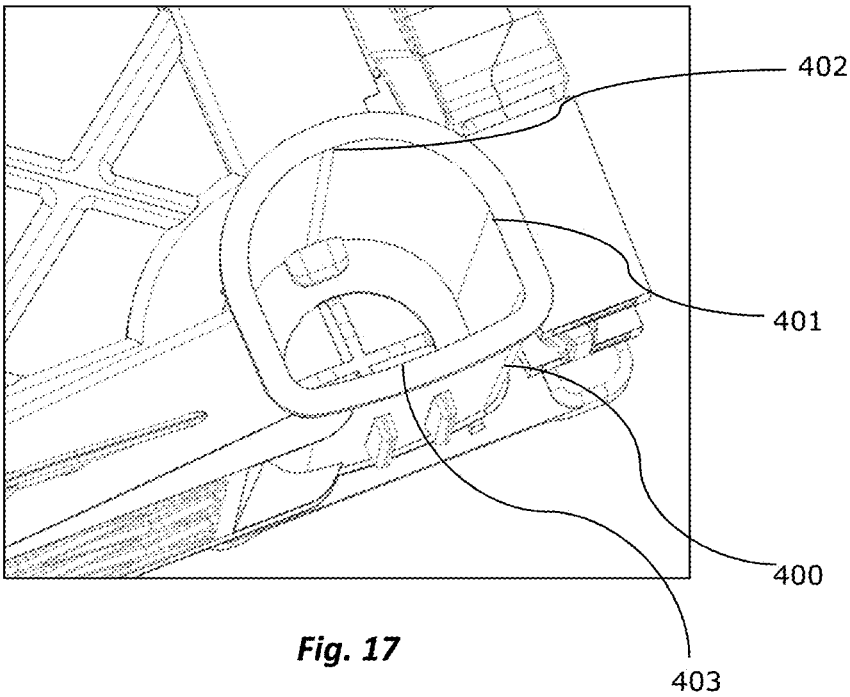
FIGS. 17 and 18 illustrate details of the container columns of the present invention.

Preferably, the male connector 127 comprises three projections placed in parallel at the horizontal axis, the central projection having a flange 128. The female connector 114 comprises two receptacles in its ends to receive the projections from the male connector ends 127 and a central opening to receive the central projection and to fix one of the flange lateral faces 128 in the female connector, as illustrated in FIG. 17. Thus, the male connector is firmly attached to the female connector and in turn they can be detached only pressing the flange 128 and sliding it backwards through the female connector 114.

Continuing with FIG. 11, in the zone between column 400 and the female connector 114, guides 115 are configured in the form of triangular ribs and which help to easy and clearly introduce the male connector in the female connector.

Figure 12:
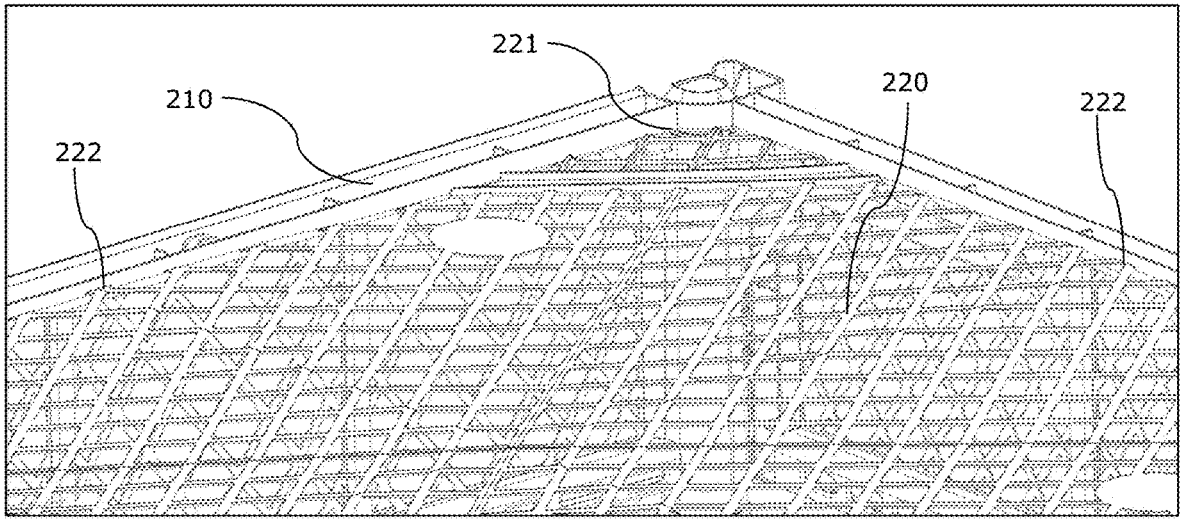
FIG. 12 illustrates a detail of the container bottom frame of the present invention.

As illustrated in FIG. 12, which illustrates a detail of the lower face of the container bottom 200, being said bottom formed by a bottom frame 210 and a bottom base 220, which in the illustrated embodiment is formed by a series of rectangular shaped strips arranged diagonally from the bottom frame 210. The bottom base 220 is vertically displaced in relation to the bottom frame 210. This displacement is lower and continued in the center zone of the frame and it is higher towards the container corners, therefore forming a parabolic profile of the framework of which highest point 221 is positioned in the corners and the lowest point 222 is positioned in the center of each face of the frame.

Figure 13:
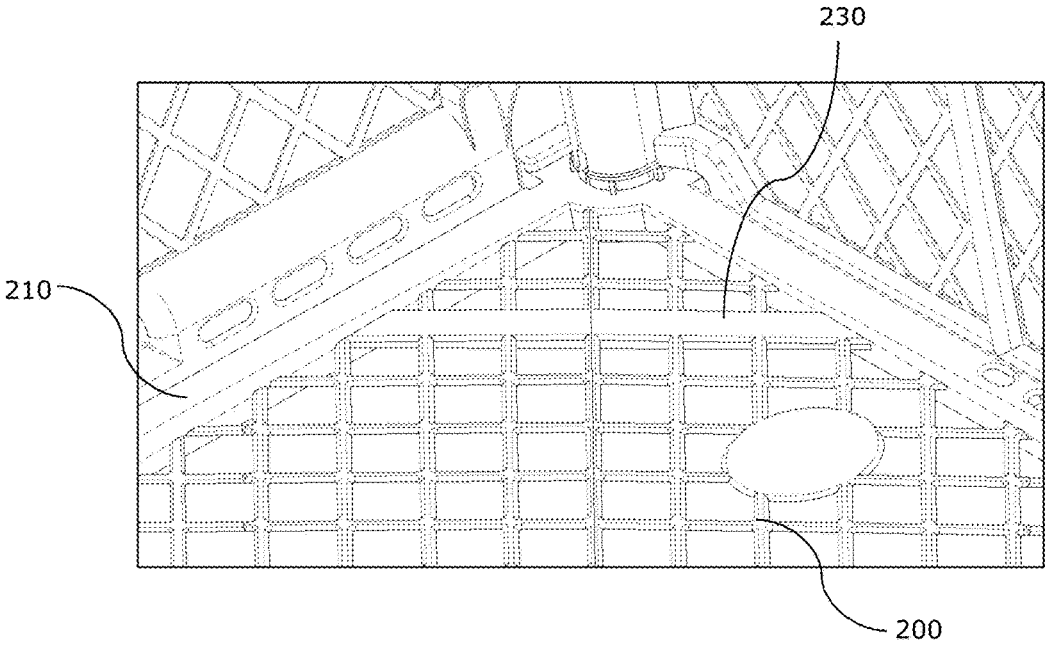
FIGS. 13 to 15 illustrate details of the container bottom structure of the present invention.
Figure 14:
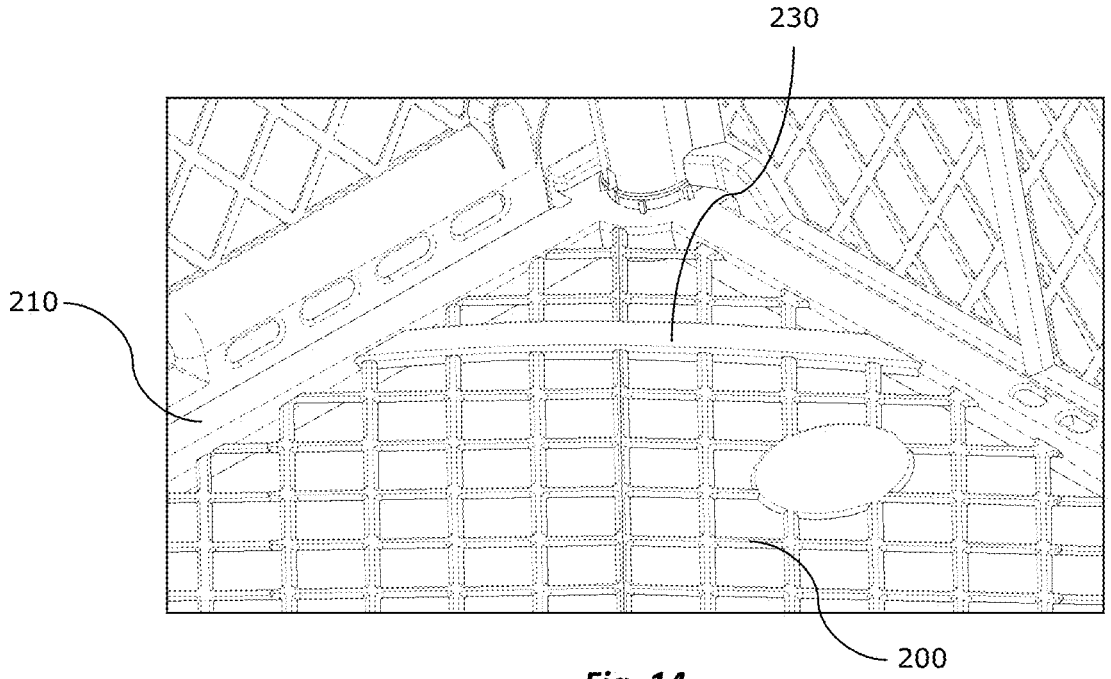

Another feature of the suggested container bottom 200 is illustrated in FIGS. 13 and 14 and it is related to rectangular beams 230 in the diagonals joining the bottom frame profiles 210. Preferably, the beams 230 have a profile in the form of a straight "C" with flat upper face. According to the FIG. 13 embodiment, the beams 230 can be straight or semi straight. Additionally and according to FIG. 14, the beams 230 can be curved towards the container corners and even in other embodiments they could be curved upwards and alternatively upwards ad towards the corners simultaneously.

Figure 15:
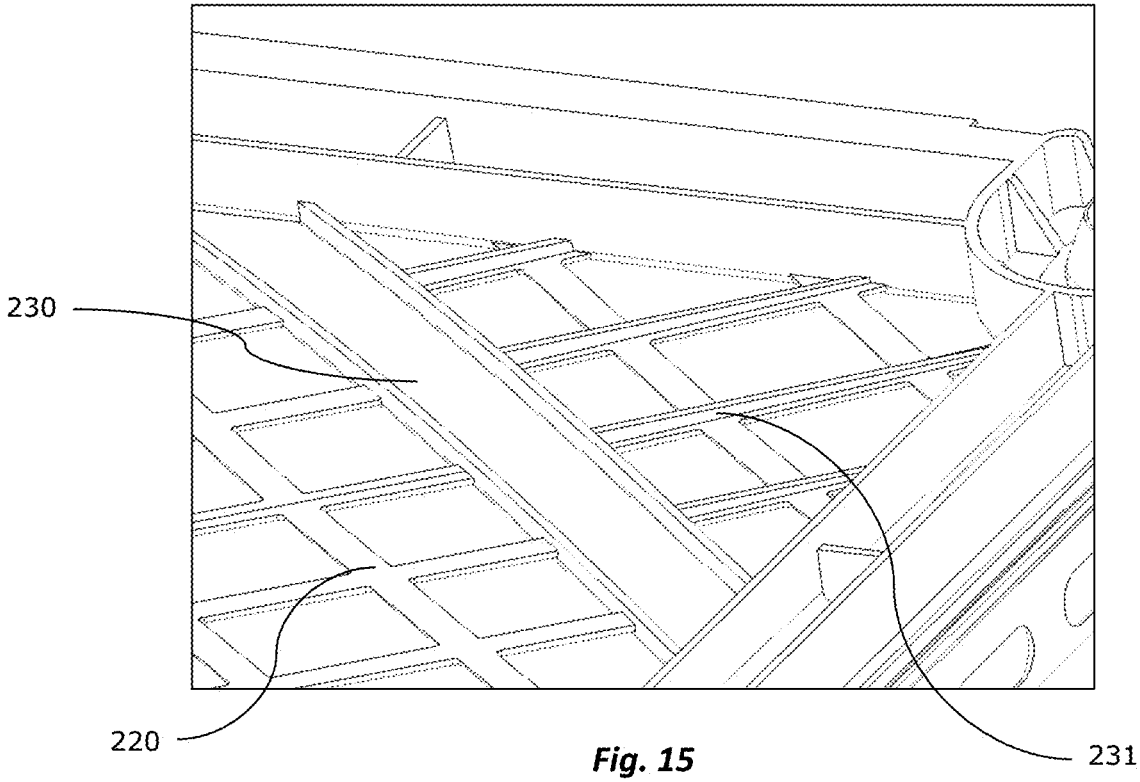

FIG. 15 teaches another feature of the container bottom, wherein it can be seen that the bottom base portion 220 placed between each column and each beam 230 also comprises T shaped ribs 231, that is to say, the vertical projections rise from the lower face of the bottom base, preferably they are placed in parallel in the framework diagonals running in only one direction (main diagonal). The ribs height is also aligned with the beams 230 lower face.

Figure 16:
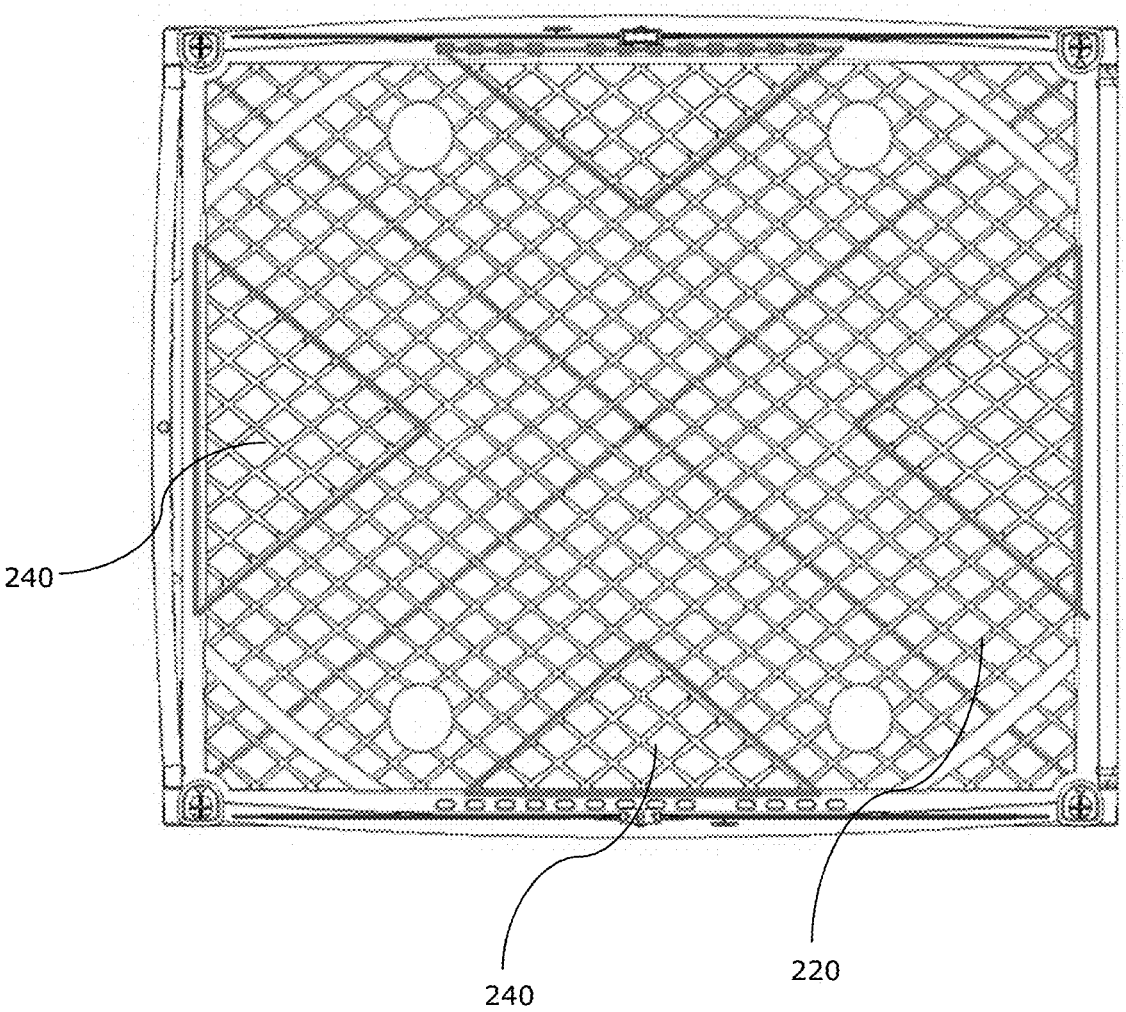
FIG. 16 illustrates a detail of the container bottom upper face of the present invention.

As it can be seen in FIG. 16, the bottom base 220 comprise zones with less material 240 consisting of a reduction in the thickness and/or width of the framework within the zones represented by triangles which are placed in each face center of the bottom.

Figure 18:
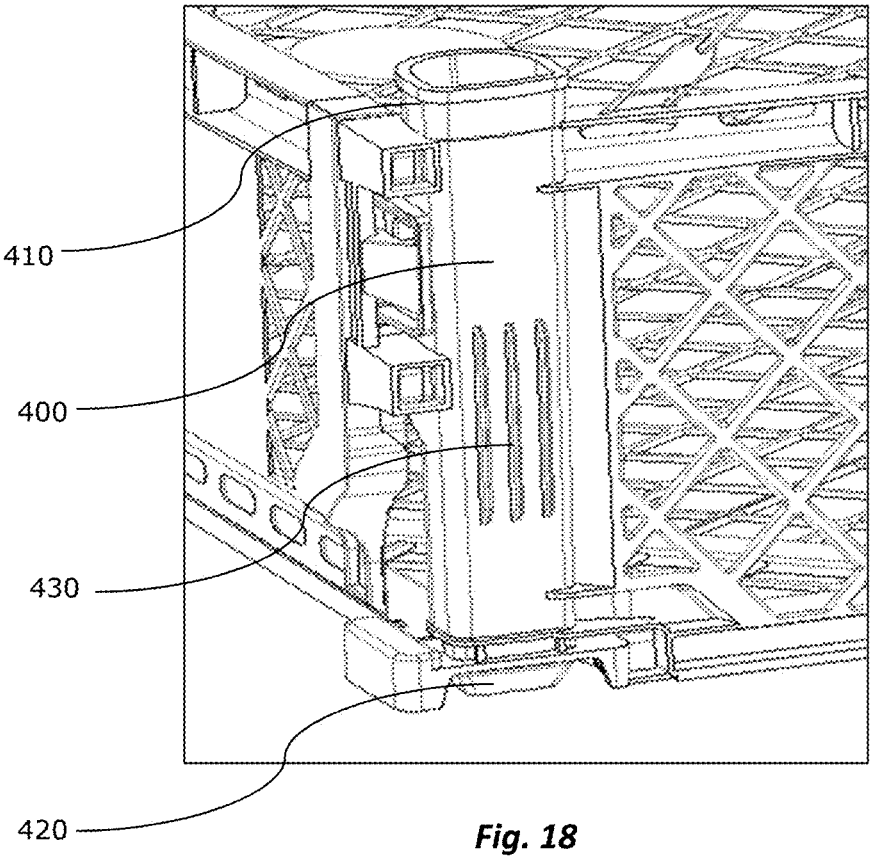

As it can be seen in FIG. 17, the columns 400 are configured in a hollow tubular shape with a cross section formed by straight portions 401 at the sidelines, a first curved portion 402 at the inner side and a second curved portion 403 at the outer side, the first curved portion 402 having a bending radius higher than the second portion 403. Also, according to FIG. 18 the column 400 in its upper end has an upper widening 410 and in its lower end has a lower projection 420 the latter being configured to be introduced and to fit with the upper widening 410 of a lower container during palletizing. In the column outer face portion 400 specifically the one oriented parallel to the container small walls, vertical ribs 430 are configured with a form of vertical and parallel straight bands protruding from the surface.

Figure 19:
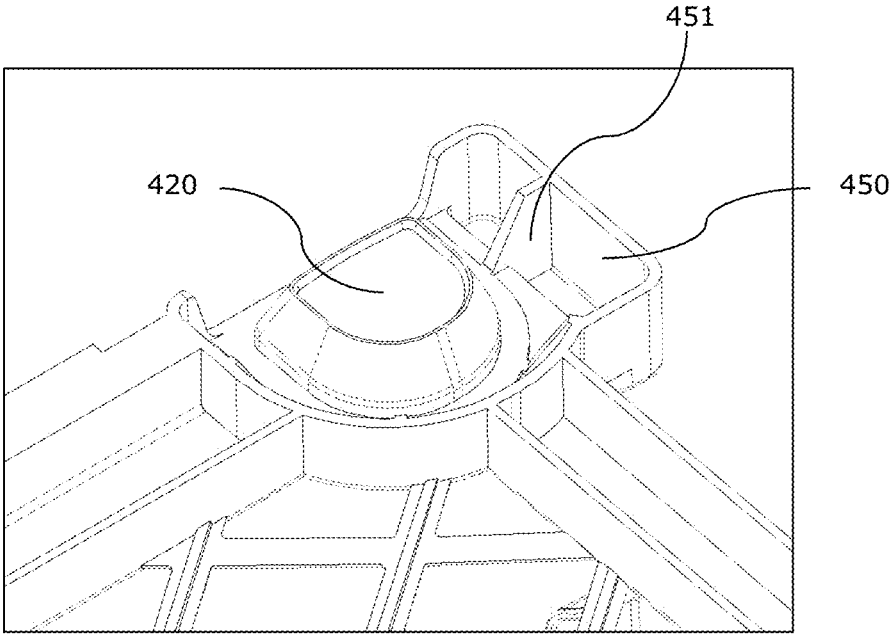
FIG. 19 illustrates a projection placed in the lower surface of the container corners of the present invention.

In relation to FIG. 19, it can be seen that the lower projection 420 is half ellipsed shaped comprising a slight conicity in the lateral faces and in the face pointing outwards the pallet. The face pointing outwards the pallet is less marked or straight curved shaped. In addition, the column lower portion comprises an extension 450 protruding thereof in a direction parallel to the small wall and the lowered or beveled inner ribs 451 surrounding the lower projection 420, are arranged inside it.

Figure 20:
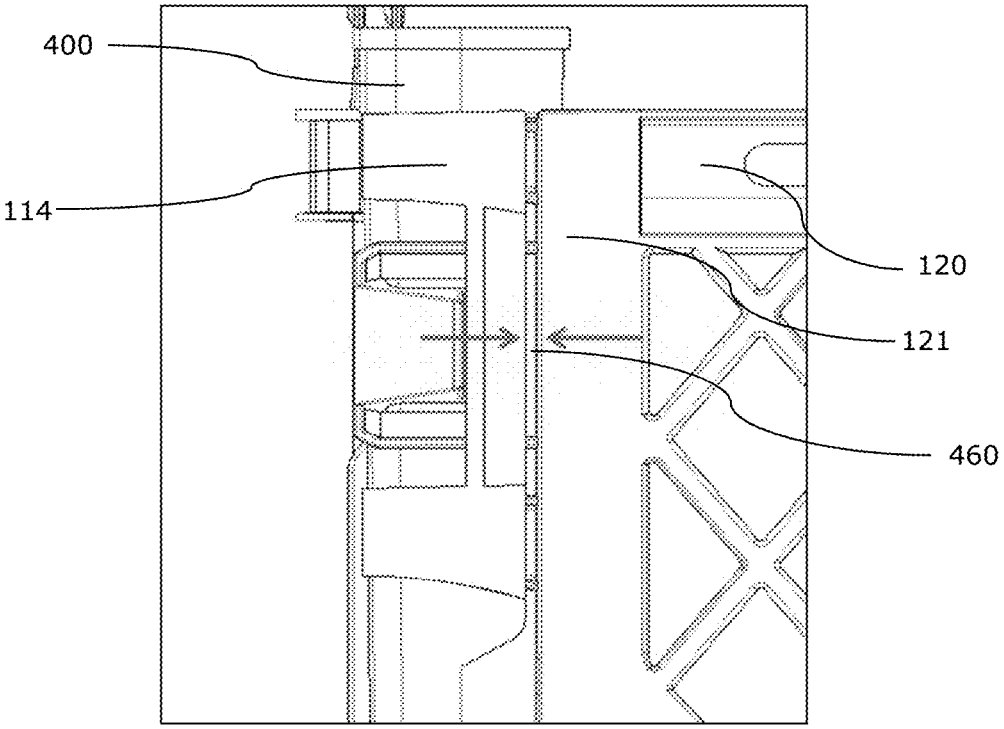
FIG. 20 illustrates a detail of the joint between the container walls of the present invention.

As illustrated in FIG. 20, between pillars 400 and the container small walls 120 a space or separation 460 is configured (see as represented between arrows), preferably in the small wall arranged outwards the pallet. Preferably, said space 460 is produced between the small wall frame 121 and the female connector receptacles 114 and according to a particular embodiment (not illustrated) said separation is more marked near the wall upper end gradually decreasing in the lower direction.

Figure 21:
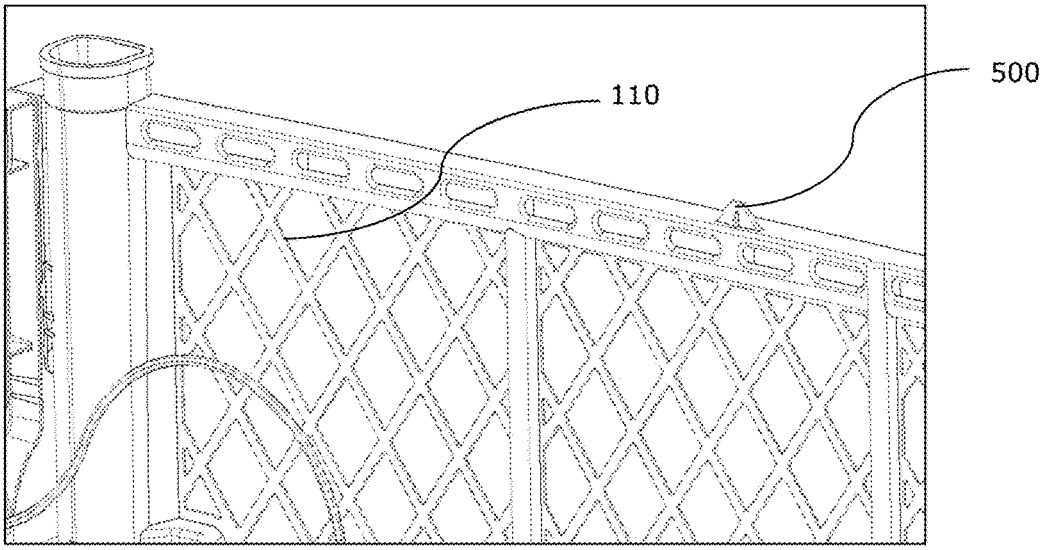
FIGS. 21 and 22 illustrate the retention elements arranged in the walls and bottom of the container of the present invention.
Figure 22:
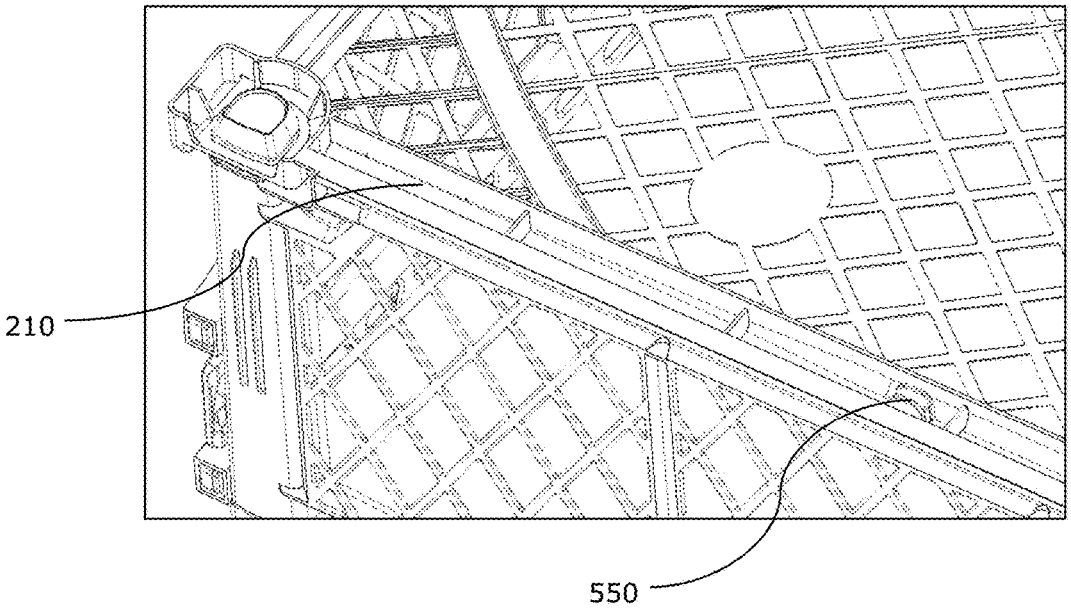

As it can be seen in FIG. 21, the container of the present invention comprises in the large walls upper face 110 at least one trapezoidal centering device 500 and in the bottom frame lower face 210 at least one channel 550. Preferably, several channels 550 are arranged one after another and configured to fit and to temporarily block the container centering devices below during palletizing.

Figure 23:
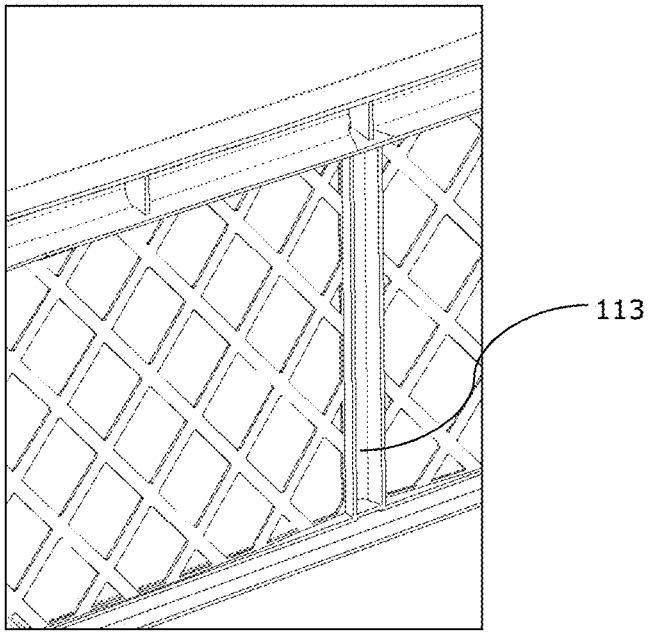
FIGS. 23 and 24 illustrate an alternative configuration of the container walls of the present invention.
Figure 24:
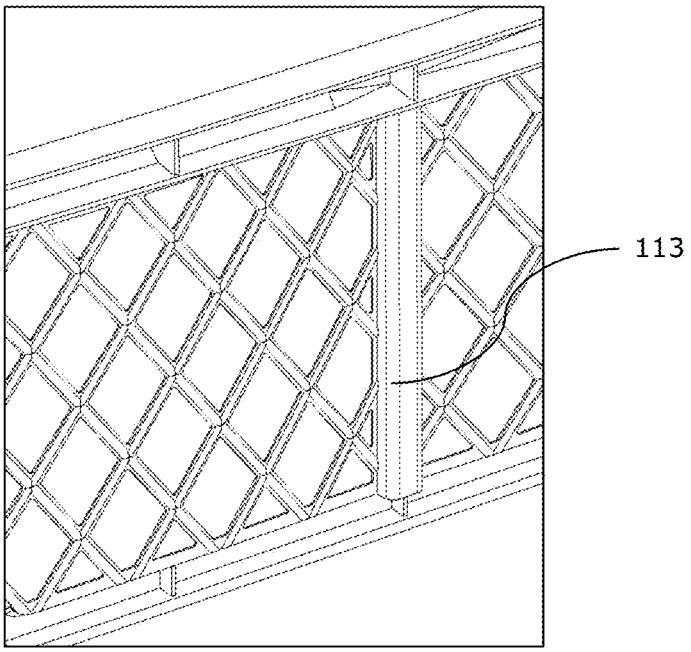

Regarding FIGS. 23 and 24, there are two configurations of the large wall secondary posts 113 which have a curved "C" shaped cross section. The first configuration illustrated in FIG. 23 wherein the posts have an open face outwards the container and a second configuration illustrated in FIG. 24, wherein the posts have an open face inwards the container. By means of this last configuration, it is possible to simplify the mould design for manufacturing the piece, therefore facilitating the container manufacturing process.

The invention claimed is:

1. A collapsible plastic container weighing less than 450 gr for containing and transporting horticultural products which allows to control deformation of the structure on forces and to maintain the integrity of the products inside it, the container comprising a bottom, large walls, small walls, vertical columns and an upper closure, wherein:

the large walls and one of the small walls of the container are curved outwards;

the upper closure is configured by flexible straps equidistantly distributed in the upper face of two container walls; and at least the small wall is curved outwards and comprises a projection in its upper face configured to connect with an additional strap of the upper closure.

2. The plastic container according to claim 1, wherein the large walls are formed by a greater wall frame configured between the vertical columns comprising a surface divided by three large wall secondary posts positioned equidistantly.

3. The plastic container according to claim 2, wherein said surface consists of a large wall lattice.

4. The plastic container according to claim 2, wherein said surface is closed and flat.

5. The plastic container according to claim 2, wherein portions of the surface that are positioned between the secondary posts of the large wall are slightly curved outwards.

6. The plastic container according to claim 1, wherein the small walls of the container are formed by a small wall frame comprising a surface divided by small wall secondary posts positioned at the center of the wall.

7. The plastic container according to claim 6, wherein said surface consists of a small wall lattice.

8. The plastic container according to claim 6, wherein a part of said surface is closed.

9. The plastic container according to claim 6, wherein in the lower portion of the small walls, two recesses are configured.

10. The plastic container according to claim 9, wherein said recesses comprise holes.

11. The plastic container according to claim 1, wherein holes are configured in the upper portion of the walls.

12. The plastic container according to claim 1, wherein the walls are fixed on the bottom and inter-connectable by wall connection media.

13. The plastic container according to claim 12, wherein the wall connection media consist of a male connector positioned in each end of the small wall and a female connector positioned in a lateral face of each column.

14. The plastic container according to claim 13, wherein:

the male connector comprises a plurality of projections;

at least one projection of the plurality of projections comprises a flange; and the female connector comprises receptacles at its ends that define an opening.

15. The plastic container according to claim 13, wherein guides are configured between the column and the female connector.

16. The plastic container according to claim 12, wherein a separation is configured between columns and at least a small wall.

17. The plastic container according to claim 16, wherein the separation is deeper next to the upper end of the wall and gradually decreases in the lower direction.

18. The plastic container according to claim 1, wherein in the upper face of the large walls, it comprises further comprising:

at least one trapezoidal shaped centering device disposed in the upper face of each of the large walls; and at least one channel disposed in a bottom lower face.

19. The plastic container according to claim 1, wherein the upper closure is configured by three flexible straps attached to the walls by terminals, wherein the three straps attached to each wall converge in their ends in hook means.

20. The plastic container according to claim 1, wherein the bottom comprises a bottom base and a bottom frame wherein said bottom base is vertically displaced in relation to the bottom frame, this displacement being lower and continued in the center zone of the bottom frame and being higher towards the container corners forming a parabolic profile of the bottom base of which the highest point is positioned in the corners and the lowest point is positioned in the center of each face of the bottom frame.

21. The plastic container according to claim 1, wherein the columns are arranged in each corner of the container and have a hollow tubular shape.

22. The plastic container according to claim 1 further comprising at least one centering device in the large walls upper face and at least one channel in a bottom lower face.

* * * * *